US008143544B2

(12) United States Patent
Yang et al.

(10) Patent No.: US 8,143,544 B2
(45) Date of Patent: Mar. 27, 2012

(54) SWITCH

(75) Inventors: Xin Yang, Shenzhen (CN); Wei Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 286 days.

(21) Appl. No.: 12/616,154

(22) Filed: Nov. 11, 2009

(65) Prior Publication Data

US 2010/0163392 A1 Jul. 1, 2010

(30) Foreign Application Priority Data

Dec. 30, 2008 (CN) ..... 2008 1 0306660

(51) Int. Cl.
*H01H 13/14* (2006.01)

(52) U.S. Cl. ..... 200/530

(58) Field of Classification Search ..... 200/530, 200/520, 502, 5 R–5 EA, 531, 534, 536, 200/238, 239, 241, 252, 332.1, 330, 341
See application file for complete search history.

(56) References Cited

U.S. PATENT DOCUMENTS

| | | | | |
|---|---|---|---|---|
| 5,959,273 | A * | 9/1999 | Chou | 200/332.1 |
| 2008/0053807 | A1 * | 3/2008 | Chou | 200/341 |
| 2010/0236911 | A1 * | 9/2010 | Wild et al. | 200/345 |

* cited by examiner

*Primary Examiner* — Edwin A. Leon
(74) *Attorney, Agent, or Firm* — Altis Law Group, Inc.

(57) ABSTRACT

A switch includes a housing, a sliding member, and at least one connecting button. The housing includes at least one conductive member. The sliding member is slidably received in the housing. The sliding member includes at least one connecting member and at least one bevel surface. The connecting button is connected to the bevel surface. The connecting button is operable to be pressed to move along a pressing direction, and push the bevel surface such that the sliding member slides along a sliding direction substantially perpendicular to the pressing direction of the connecting button. The connecting member is electrically connected to the conductive member when the sliding member slides to a first position.

14 Claims, 7 Drawing Sheets

SWITCH

BACKGROUND

1. Technical Field

The present disclosure relates to switches, and particularly to a switch used in an electronic device.

2. Description of Related Art

Switches are widely used in electronic devices. Typically, a switch includes a curved conductive sheet, and a button connected to the top of the conductive sheet. When pressures are exerted on the button, the button will press the conductive sheet such that the conductive sheet is deformed to generate restoring forces from an original state, and contacts with an electrical contact mounted on a circuitry of the electronic device, so that the circuitry is closed. When the pressures are released, the conductive sheet will return to the original state via the restoring forces. However, restoring forces of the conductive sheet may be weakened after repeated deformations, thus the reliability of the switch decreases with use.

Therefore, it is desirable to provide a switch which can overcome the above-mentioned problems.

BRIEF DESCRIPTION OF THE DRAWINGS

The components of the drawings are not necessarily drawn to scale, the emphasis instead being placed upon clearly illustrating the principles of the embodiments of a switch. Moreover, in the drawings, like reference numerals designate corresponding parts throughout several views.

DETAILED DESCRIPTION

Embodiments of the present disclosure will now be described in detail with reference to the drawings.

Figure 1:
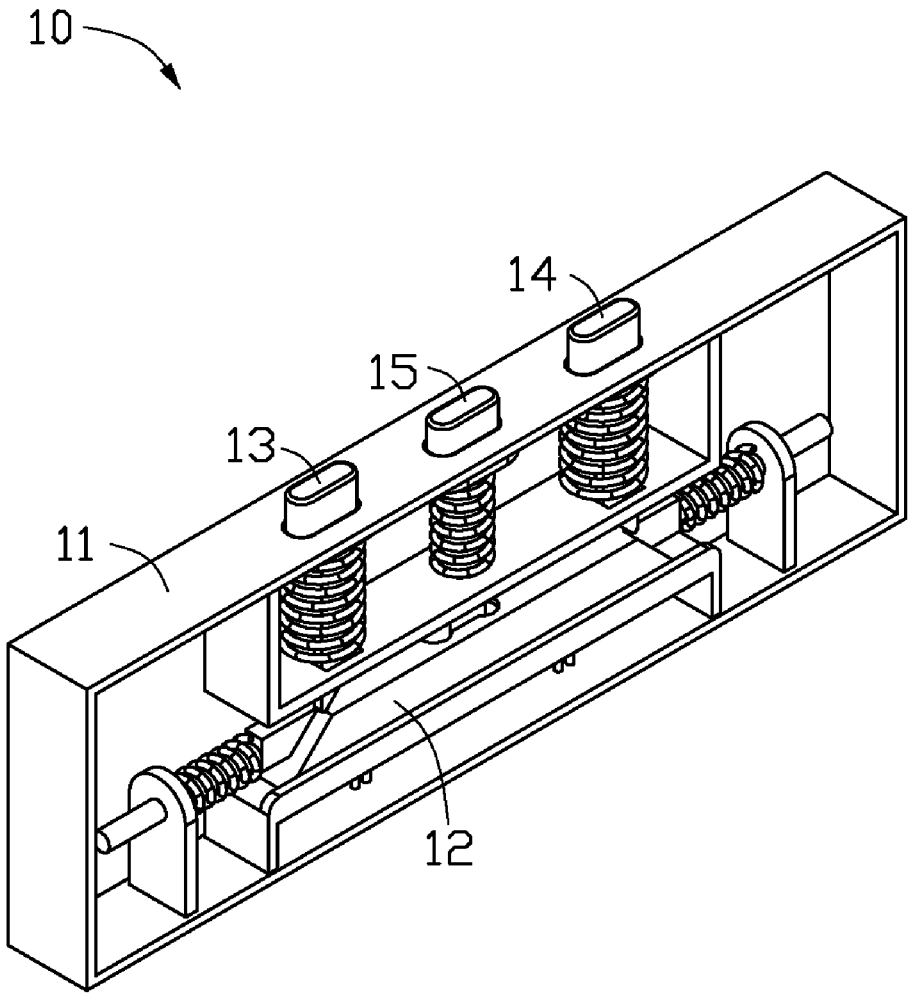
FIG. 1 is an isometric view of a switch in accordance with an exemplary embodiment.

Referring to FIG. 1, a switch 10 includes a housing 11, a sliding member 12, two connecting buttons 13, 14, and a positioning button 15. The sliding member 12 is slidably received in the housing 11. The connecting buttons 13, 14, and the positioning button 15 are partially received in the housing 11.

Figure 2:
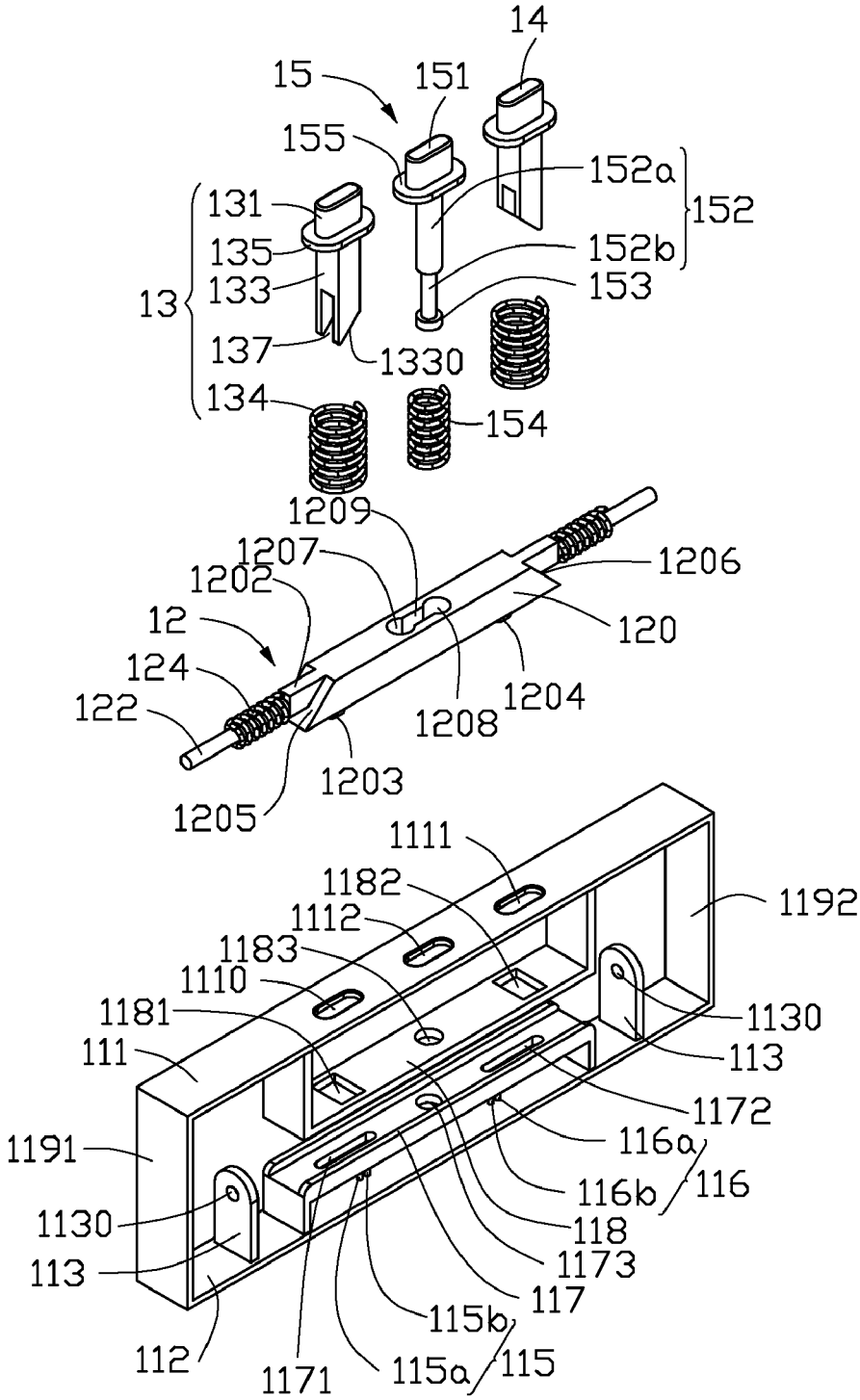
FIG. 2 is an exploded view of the switch of FIG. 1.
Figure 3:
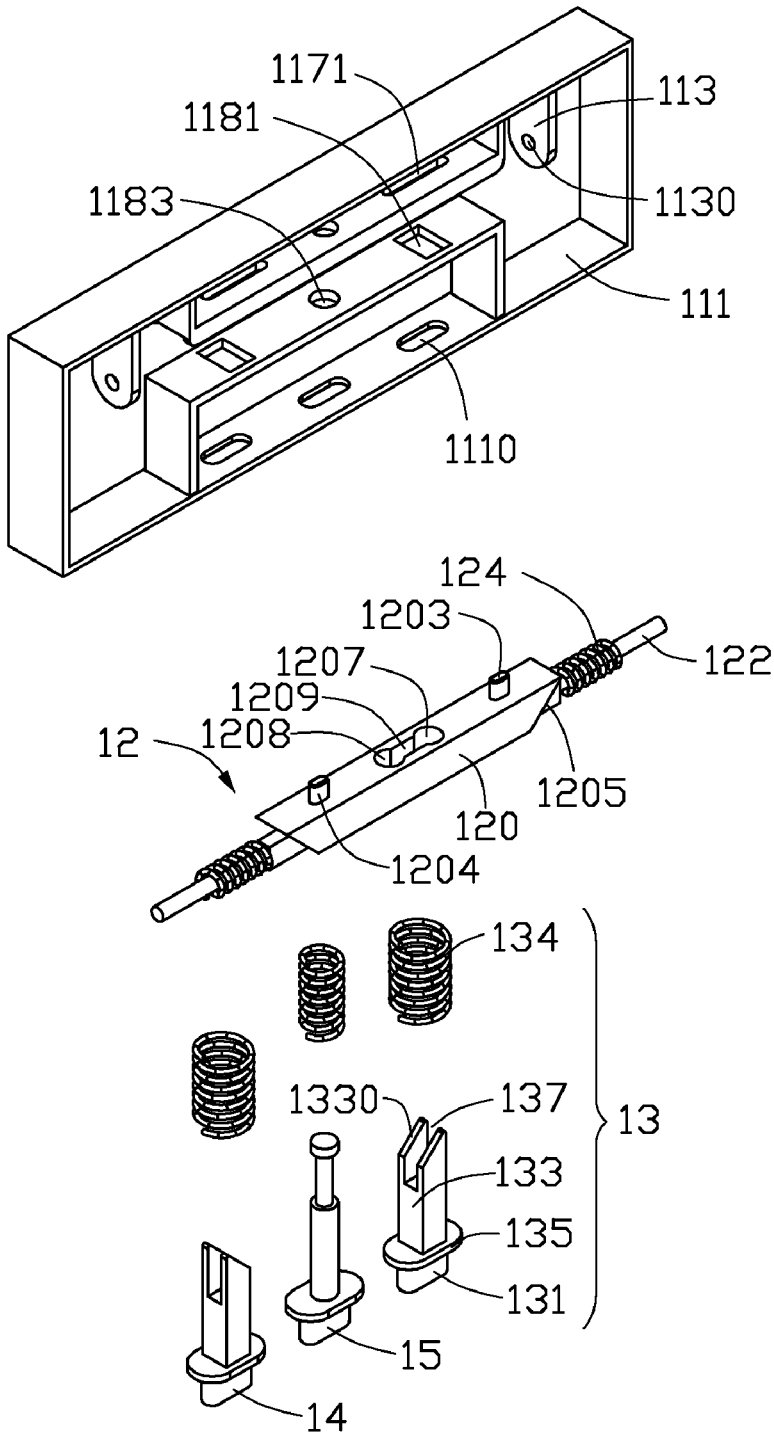
FIG. 3 is an exploded view of the switch of FIG. 1, but viewed from a reverse direction to FIG. 2.

Referring to FIGS. 2 and 3, the housing 11 is substantially rectangular. The housing 11 includes a first sidewall 111, a second sidewall 112, a third sidewall 1191, and a fourth sidewall 1192. The second sidewall 112 is parallel to the first sidewall 111. The third sidewall 1191 and the fourth sidewall 1192 are connected between the first sidewall 111 and the second sidewall 112 to form the housing 11. The housing 11 further includes two supporting members 113, a first conductive member 115, a second conductive member 116, a first bracket 117, and a second bracket 118.

The first sidewall 111 defines three positioning through holes 1110, 1111, 1112, which are substantially rectangular and arranged in a straight line.

The supporting members 113 are substantially rectangular plates extending from the second sidewall 112. Each supporting member 113 defines a sliding through hole 1130 in a distal end. The supporting members 113 are parallel to each other, such that the two sliding through holes 1130 are aligned with each other correspondingly.

The first and second conductive members 115, 116 are disposed on the second sidewall 112 between the supporting members 113. The first conductive member 115 includes two conductive columns 115*a* and 115*b* separated from each other. The second conductive member 116 includes two separated conductive columns 116*a*, 116*b* separated from each other. The conductive members 115, 116 are configured to interconnect circuitries of an electronic device (not shown).

The first bracket 117 is disposed on the second sidewall 112. A top plate of the first bracket 117 is located above the conductive members 115, 116. The first bracket 117 defines two sliding slots 1171, 1172, and a receiving through hole 1173 located between the two sliding slots 1171, 1172. The receiving through hole 1173 is aligned with the positioning through hole 1112. The sliding slots 1171, 1172 are located above the conductive members 115, 116 correspondingly.

The second bracket 118 is disposed on the first sidewall 111. A bottom plate of the second bracket 118 is located above the first bracket 117, and defines three limiting through holes 1181, 1182, 1183. The limiting through holes 1181, 1182 are rectangular, and the limiting through hole 1183 is circular. The limiting through holes 1181, 1182, 1183 are aligned with the positioning through holes 1110, 1111, 1112, correspondingly.

The sliding member 12 includes a main body 120, two sliding rods 122, and two positioning springs 124. The sliding rods 122 extend from opposite sides of the main body 120 correspondingly. The positioning springs 124 are sleeved on the sliding rods 122 correspondingly.

The main body 120 is a trapezoid in shape, and includes two bevel surfaces 1205, 1206, and two fixing portions 1202 extending from the two bevel surfaces 1205, 1206 correspondingly. The main body 120 further includes two connecting members 1203, 1204 extending from a bottom surface of the main body 120. The connecting members 1203, 1204 are electrically conductive. The main body 120 defines two fixing through holes 1207, 1208, and a rectangular positioning slot 1209 communicating with the two fixing through holes 1207, 1208.

The two sliding rods 122 are fixed to the two fixing portions 1202 correspondingly. Each positioning spring 124 is sleeved on a corresponding sliding rod 122 and stopped by a corresponding fixing portion 1202.

The connecting button 13 includes a pressing portion 131, a connecting portion 133, a limiting portion 135, and a spring 134. The pressing portion 131 is a substantially rectangular block. The connecting portion 133 is a right trapezoidal body and includes a bevel edge 1330. The connecting portion 133 defines an opening 137 in a distal end. The bevel edge 1330 is mid-sectioned by the opening 137. The limiting portion 135 is a plate protruding from a peripheral of one end of the pressing portion 131, and located between the pressing portion 131 and the connecting portion 133. The spring 134 is sleeved on the connecting portion 133 and blocked by the limiting portion 135.

The second connecting button 14 has a similar structure as the first connecting button 13.

The positioning button 15 includes a pressing portion 151, a connecting portion 152, a limiting portion 155, a positioning portion 153, and a spring 154. The pressing portion 151 and the limiting portion 155 have similar structures as the pressing portion 131 and the limiting portion 135. The connecting portion 152 includes a cylindrical upper rod 152*a* and a cylindrical lower rod 152*b*. The upper rod 152*a* is connected to the limiting portion 155. The lower rod 152*b* is concentrically connected to the upper rod 152*a*. The positioning portion 153 is a cylindrical body concentrically connected to a distal end of the lower rod 152*b*. The spring 154 is sleeved on the connection portion 152 and blocked by the limiting portion 155. The length of the spring 154 in a normal state is longer than the height of the second bracket 118.

Figure 4:
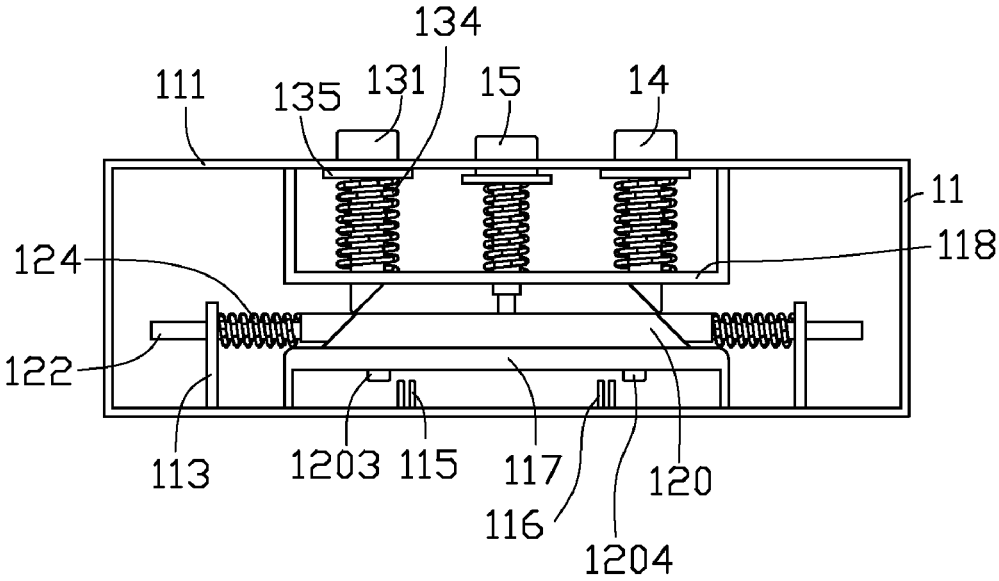
FIG. 4 is a schematic, left view of the switch of FIG. 1 in a first state.
Figure 5:
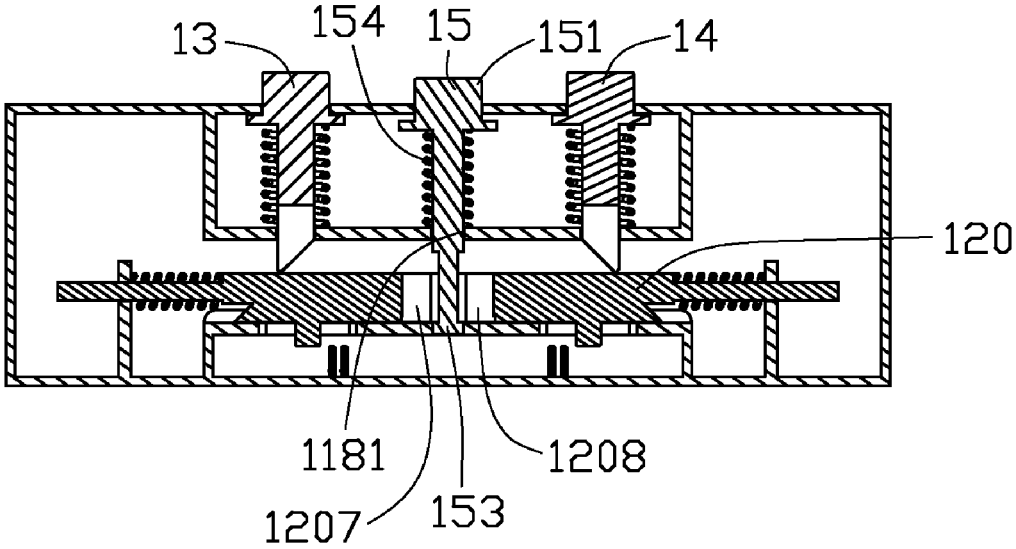
FIG. 5 is a cross-sectional view of the switch of FIG. 4.

Further referring to FIGS. 4 and 5, in assembly, the sliding member 12 is disposed on the first bracket 117. The two connecting members 1203, 1204 are inserted into the two sliding slots 1171, 1172 correspondingly. The two bevel surfaces 1205, 1206 are located under the limiting through holes 1181, 1182 correspondingly. The sliding rods 122 are inserted through the sliding through holes 1130, such that the sliding member 12 can slide on the first bracket 117.

The connecting portion 133 is inserted through the limiting through hole 1181 and sleeved on the fixing portion 1202. The bevel edge 1330 contacts the bevel surface 1205. The pressing portion 131 is inserted through the positioning through hole 1110 and extends out of the first sidewall 111. The spring 134 and the limiting portion 135 are located between the second bracket 118 and the first sidewall 111. The connecting button 14 is assembled into the housing 11 in a similar manner as the connecting button 13.

The connecting portion 152 is inserted through the limiting through hole 1183 and the fixing through hole 1207, such that the positioning portion 153 is received in the receiving through hole 1173. The pressing portion 151 is inserted through the positioning through hole 1112 and extends out of the first sidewall 111. The spring 154 and the limiting portion 155 are located between the second bracket 118 and the first sidewall 111. The spring 154 is compressed by the limiting portion 155 and the second bracket 118. The sliding member 12 is moved until the positioning slot 1209 is aligned with the receiving through hole 1173 and the limiting through hole 1183. As a result, the lower rod 152*b* is received in the positioning slot 1209 and the positioning portion 153 is limited in the receiving through hole 1173 by the main body 120. At the same time, the limiting portion 155 is at a distance away from the first sidewall 111.

Figure 6:
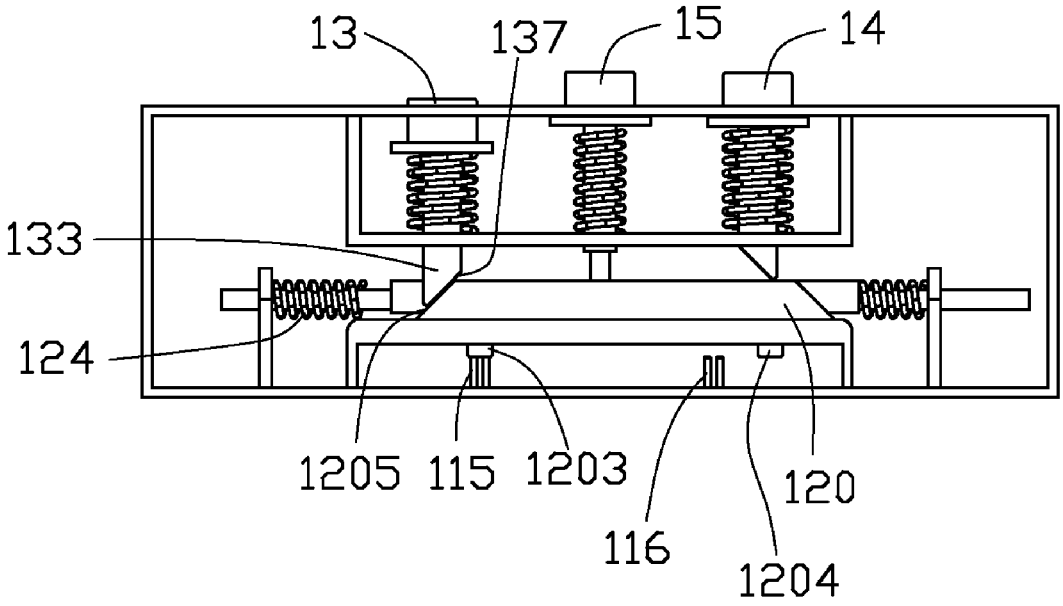
FIG. 6 is a schematic, left view of the switch of FIG. 1 in a second state.
Figure 7:
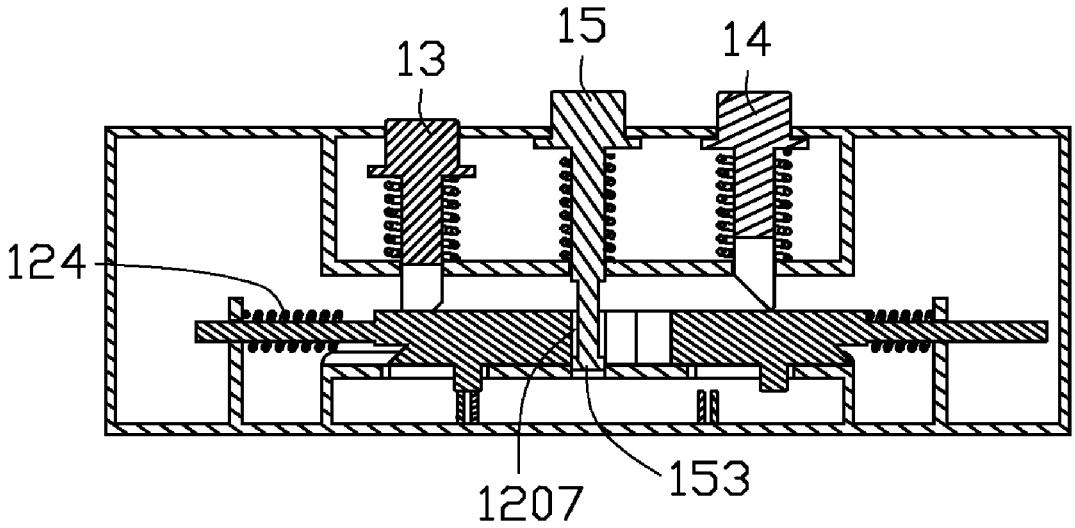
FIG. 7 is a cross-sectional view of the switch of FIG. 6.

Referring to FIGS. 6 and 7, in operation, when the pressing portion 131 is pressed, the bevel surface 1205 becomes pressed by the connecting portion 133, and the sliding member 12 slides toward the connecting button 14. As a result, the connecting member 1203 contacts the conductive member 115 to electrically interconnect the conductive columns 115*a* and 115*b*. At the same time, the fixing through hole 1207 is aligned with the receiving through hole 1173 and the limiting through hole 1183, and the positioning button 15 is pushed by the spring 154. Accordingly, the positioning portion 153 returns to a normal position corresponding to the fixing through hole 1207 limiting the sliding member 12 to move. As a result, the conductive member 115 remains electrically connected to the connecting member 1203. In this condition, the positioning spring 124 adjacent to the button 14 is compressed by one of the fixing portions 1202 and one of the supporting members 113 correspondingly. When the connecting button 13 is depressed, the connecting portion 131 is pushed by the spring 134.

Then, when the positioning button 15 is pressed, the positioning portion 153 is pressed into the receiving through hole 1173, and the sliding member 12 returns to a normal position. As a result, the conductive member 115 does not conduct. Similar to the connecting button 13, when the connecting button 14 is pressed, the connecting member 1204 is electrically connected to the conductive member 116.

It should be mentioned that, the connecting button 14 can be omitted in an alternative embodiment. Correspondingly, the conductive member 116 and the connecting member 1204 also can be omitted.

It should also be understood that, in another alternative embodiment, one end of the positioning spring 124 can be fixed to the supporting member 113, and the other end of the positioning spring 124 can be fixed to the fixing portion 1202. When the shifted main body 120 is not blocked, the stretched positioning spring 124 can draw back the shifted main body 120.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A switch, comprising:

a housing comprising at least one conductive member, each of the at least one conductive member comprising a pair of conductive columns separated from each other;

a sliding member slidably received in the housing, the sliding member comprising at least one connecting member and at least one bevel surface; and at least one connecting button connected to the at least one bevel surface, the at least one connecting button being operable to be pressed to move along a pressing direction, and push the at least one bevel surface such that the sliding member slides along a sliding direction substantially perpendicular to the pressing direction of the at least one connecting button, the at least one connecting member each being operable to electrically interconnect the pair of conductive columns of a corresponding one of the at least one conductive member when the sliding member slides to a first position.

2. The switch of claim 1, wherein the at least one connecting button comprises a trapezoidal connecting portion, the connecting portion comprises a bevel edge, the bevel edge contacts the at least one bevel surface when the at least one connecting button pushes the sliding member.

3. The switch of claim 1, further comprising at least one positioning spring connected to the sliding member, wherein the at least one positioning spring is operable to return the sliding member to a second position via applying a returning force to the sliding member when the sliding member is not blocked.

4. The switch of claim 1, wherein the housing comprises a first sidewall, a second sidewall substantially parallel to the first sidewall, and a first bracket disposed on the second sidewall, the first bracket defines at least one sliding slot, the at least one conductive member is disposed on the second sidewall and aligned with the at least one sliding slot, the sliding member is slidably disposed on the first bracket, and the at least one connecting member is inserted through the at least one sliding slot.

5. The switch of claim 4, wherein the housing further comprises two supporting members each defining a sliding through hole, the supporting members are disposed adjacent to opposite sides of the first bracket, the sliding member comprises a main body and two sliding rods fixed to the main body, the sliding rods are slidably inserted through the sliding through holes such that the sliding member is slidably disposed on the first bracket.

6. The switch of claim 5, further comprising a positioning button, wherein the main body defines at least one fixing through hole, when the at least one connecting member contacts the at least one conductive member, the positioning button is partially inserted into the at least one fixing through hole to fix the sliding member at the first position.

7. The switch of claim 4, wherein the first sidewall defines at least one positioning through hole, the at least one connecting button comprises a trapezoidal connecting portion and a pressing portion fixed to the connecting portion, the connecting portion comprises a bevel edge contacting the at least one bevel surface, the pressing portion extends out from the at least one positioning through hole.

8. The switch of claim 7, wherein the housing further comprises a second bracket disposed on an inner surface of the first sidewall, the at least one connecting button further comprises a limiting portion connected to the pressing portion and a spring sleeved on the connecting portion, the limiting portion and the spring are located between the first sidewall and the second bracket, the spring is operable to apply a resisting force to the limiting portion when the pressing portion is pressed, the limiting portion is operable to prevent the at least one connecting button from detaching from the housing.

9. A switch, comprising:

a housing comprising at least one conductive member;

a sliding member slidably received in the housing, the sliding member comprising at least one connecting member and at least one bevel surface, the sliding member defining at least one fixing through hole and a rectangular positioning slot communicating with the at least one fixing through hole;

at least one connecting button connected to the at least one bevel surface, the at least one connecting button being operable to press the at least one bevel surface such that the sliding member slides substantially perpendicular to a pressing direction of the at least one connecting button and the at least one connecting member is electrically connected to the at least one conductive member;

a positioning button comprising a connecting portion and a positioning portion connected to the connecting portion, the positioning portion operable to be inserted into the at least one fixing through hole to fix the sliding member at a first position, where the at least one connecting member is held to contact the at least one conductive member, and the positioning portion is out of the at least one fixing through hole and the connecting portion is operable to be received in the positioning slot to allow the sliding member to slide to a second position, where the at least one connecting member disengages from the at least one conductive member; and a positioning spring connected to the sliding member, the positioning spring being operable to return the sliding member to the second position.

10. The switch of claim 9, wherein the housing comprises a first sidewall, a second sidewall substantially parallel to the first sidewall, and two supporting members mounted on the second sidewall, each of the supporting member defines a sliding through hole, the sliding member comprises a main body and two sliding rods extending from opposite ends of the main body, the two sliding rods are slidably inserted through the two sliding through holes correspondingly, such that the sliding member is slidably received in the housing.

11. The switch of claim 10, wherein the housing further comprises a first bracket disposed between the two supporting members, the first bracket defines at least one sliding slot, the main body is slidably disposed on the first bracket, and the at least one connecting member extends from the main body and is inserted through the at least one sliding slot, the at least one conductive member is disposed on the second sidewall and aligned with the at least one sliding slot, the at least one connecting member is operable to move in the at least one sliding slot so as to be electrically connected to the at least one conductive member.

12. The switch of claim 11, wherein the first sidewall defines at least one positioning through hole, the at least one connecting button comprises a trapezoidal connecting portion and a pressing portion fixed to the connecting portion, the connecting portion comprises a bevel edge contacting the at least one bevel surface, the pressing portion extends out from the at least one positioning through hole.

13. The switch of claim 12, wherein the housing further comprises a second bracket disposed on the first sidewall and facing the first bracket, the at least one connecting button further comprises a limiting portion connected to the pressing portion and a spring sleeved on the connecting portion, the limiting portion and the spring are located between the first sidewall and the second bracket, the spring is operable to apply a resisting force to the limiting portion when the pressing portion is pressed, the limiting portion is operable to prevent the at least one connecting button from detaching from the housing.

14. The switch of claim 9, wherein the at least one conductive member comprises a pair of conductive columns separated from each other, the at least one connecting member is operable to electrically interconnect the pair of columns when contacting the pair of conductive columns.

* * * * *